US006039653A

United States Patent [19]

Engstrand

[11] Patent Number: 6,039,653

[45] Date of Patent: Mar. 21, 2000

[54] APPARATUS, SYSTEM AND METHOD FOR EXPERIENCING MOTION

[76] Inventor: Brad Engstrand, 2658 N. Dayton, Chicago, Ill. 50514

[21] Appl. No.: 09/192,788

[22] Filed: Nov. 16, 1998

[51] Int. Cl.[7] ..... A63G 31/04

[52] U.S. Cl. ..... 472/59; 472/60; 434/55

[58] Field of Search ..... 472/59, 60, 61, 472/130; 434/29, 55; 463/7

[56] References Cited

U.S. PATENT DOCUMENTS

| | | | |
|---|---|---|---|
| 2,485,435 | 10/1949 | Dehmel . | |
| 3,295,224 | 1/1967 | Cappel . | |
| 3,628,829 | 12/1971 | Hellig . | |
| 3,676,856 | 7/1972 | Manly . | |
| 3,865,430 | 2/1975 | Tanus . | |
| 3,923,300 | 12/1975 | Tanus . | |
| 4,030,208 | 6/1977 | Carver et al. . | |
| 4,066,256 | 1/1978 | Trumbull . | |
| 4,244,120 | 1/1981 | Harris . | |
| 4,251,140 | 2/1981 | Fogerty, Jr. . | |
| 4,527,980 | 7/1985 | Miller . | |
| 4,553,176 | 11/1985 | Mendrala . | |
| 4,616,326 | 10/1986 | Meier et al. . | |
| 4,642,945 | 2/1987 | Browning et al. . | |
| 4,710,129 | 12/1987 | Newman et al. . | |
| 4,856,771 | 8/1989 | Nelson et al. . | |
| 4,879,849 | 11/1989 | Hollingsworth, III et al. . | |
| 4,984,179 | 1/1991 | Waldern . | |
| 4,995,603 | 2/1991 | Reed . | |
| 5,009,412 | 4/1991 | Roodenburg et al. | 472/59 |
| 5,015,933 | 5/1991 | Watkins et al. . | |
| 5,021,982 | 6/1991 | Crosbie et al. . | |
| 5,066,902 | 11/1991 | Watanabe . | |
| 5,130,794 | 7/1992 | Ritchey . | |
| 5,192,247 | 3/1993 | Barr et al. . | |
| 5,433,670 | 7/1995 | Trumbull . | |
| 5,496,220 | 3/1996 | Engstrand . | |
| 5,511,979 | 4/1996 | Perfect et al. . | |
| 5,564,985 | 10/1996 | Engstrand . | |
| 5,584,697 | 12/1996 | Trumbull . | |
| 5,662,523 | 9/1997 | Yasumaru et al. | 472/60 |
| 5,678,889 | 10/1997 | Purcell, Jr. | 472/59 X |
| 5,722,897 | 3/1998 | Engstrand . | |
| 5,853,330 | 12/1998 | Engstrand . | |

FOREIGN PATENT DOCUMENTS

WO83/02028 6/1983 WIPO .

*Primary Examiner*—Kien T. Nguyen
*Attorney, Agent, or Firm*—Patents+TMS, P.C.

[57] ABSTRACT

An apparatus, a system and a method for creating motion are provided. The apparatus includes a base and a frame connected by legs with a rod extending from the base towards the frame. Cylinders, preferably pneumatic, connect to the rod to the frame. Air or fluid to the cylinders may be controlled in a programmable manner to create motion to the rod and, hence, to the base. Another connecting element is provided between the base and one of the legs which may also include a cylinder creating an additional degree of freedom and motion to the apparatus.

27 Claims, 2 Drawing Sheets

APPARATUS, SYSTEM AND METHOD FOR EXPERIENCING MOTION

BACKGROUND OF THE INVENTION

The present invention generally relates to a system and a method for simulating motion. More specifically, the present invention relates to an apparatus, a system and a method in which motion signals are recorded on a recording medium and played back for an individual to experience while sitting on, for example, a seat or platform that moves in unison with the motion that is viewed, for example, on a screen or the like.

A number of devices are generally know, particularly for amusement and entertainment providing motion or other movement to individuals simultaneously during viewing a presentation in order to provide a combined visual and motion experience. Examples of such known devices are disclosed in U.S. Pat. Nos. 4,066,256; 4,251,140; 4,642,945; and 5,015,933.

U.S. Pat. No. 4,066,256 discloses a compact ride for an amusement park creating the illusion that passengers are seated in a rapidly maneuvering vehicle by applying forces to the passenger in synchronism with the display of a motion picture image. The apparatus includes a passenger-holding frame having three locations resting on hydraulic rams that can tilt the frame or move it up and down. A film projector and viewing screen connects to the frame to move with it. When the motion picture simulates the view from the vehicle that is turning to the right, the rams are operated to tilt the vehicle to the left to simulate the centrifugal forces that would result from a vehicle turning to the right. When the motion picture indicates forward acceleration, the vehicle is tipped backwardly. When the motion picture indicates vertical acceleration, the rams are rapidly moved up or down.

U.S. Pat. No. 4,251,140 discloses a ride assembly for simulating travel in a pre-programmed environment to passengers. The assembly includes a housing having a moveable base adapted for carrying passengers thereon. The assembly also includes a pair of supporting carriage members, the first carriage member being movably supported at the upper surface of a stationary support cradle member by a first set of bearings which allow the first carriage member to pitch about a fixed-pitch axis associated with the cradle member. The first carriage member movably supports the second carriage member at its upper surface by a second set of bearings which allows the second carriage member to roll about a variable-roll axis associated with the first carriage member. The base is fixably mounted on the second carriage member, and each portion of the base is moved through a range of pitch and roll positions. An audio-visual presentation having a sound motion picture film projector in combination with a sound system are disposed on the base and develops a sound motion picture on a spherical inner surface of the housing. The housing is mounted on the base to move therewith. Motors independently drive the first carriage member and the second carriage member under the control of a control circuit in order to move the base in synchronism with the movement of one of the projected moving objects of the moving picture wherein the motion of the base is controlled to simulate a scene moving relative to a housing as view by the carried passengers.

U.S. Pat. No. 4,642,945 relates to an entertainment center having a horizontally disposed floor or decking support plate on which seating for members of an audience is arrangeable and support means on which the support plate is rotatably mounted. Orientation veering means are operable to tilt the support plate from the horizontal while drive means are operable to rotate the support plate on a support means about an upwardly extending axis. The structure also includes a drive system operable to actuate the orientation veering means, and control means operable to control actuation of the drive means and the drive system for veering the angular disposition and tilt of the support plate with respect to the axis. During presentation of a cinematic program, a viewer's perception of the action is enhanced by rotation and tilting being synchronized with visual and aural action of the program.

U.S. Pat. No. 5,015,933 generally discloses an automated control of seat motion for seat systems used to provide combined visual and motion experience in amusement rides and the like. Occupant safety features are integrated within the seat motion control system and centralized control of multiple motion bases is accomplished. Motion control of the seat bases is responsive to a position signal input coordinated with a visual presentation viewed by the patrons. Self-contained power systems for the actuation means of the seat base allow sizing of an entertainment theater to accommodate anticipated audiences.

Each of the known devices, however, is complex, requires significant components, both mechanical and structural, to simulate the desired motion.

A need, therefore, exists for a simplified apparatus, system, and method that simulates motion in the seat on which the same is viewed.

SUMMARY OF THE INVENTION

The present invention provides an apparatus, a system and method for experiencing motion. To this end, in an embodiment of the present invention, the apparatus has a frame. A base is substantially parallel to the frame in a resting position and remotely situated from the frame. A rod extends from the base in a direction towards the frame. A first cylinder is connected between the rod and the frame. A second cylinder is connected between the rod and the frame wherein the first cylinder and the second cylinder expand and contract to provide motion to the base.

In an embodiment, a connecting element is provided between the frame and the base wherein the connecting element includes a ball joint.

In an embodiment, a third cylinder is incorporated with the connecting element.

In an embodiment, a ball joint is provided at each end of each of the first cylinder and the second cylinder wherein the first cylinder and the second cylinder commonly meet at one end vertically disposed from each other.

In an embodiment, a ball joint is provided between the base and the rod.

In an embodiment, a connecting element has first and second ball joints wherein the connecting element is attached at one end to the base and at an opposite end to the frame.

In an embodiment, a plurality of legs extend between the frame and the base wherein the plurality of legs are disposed to meet at a point beneath the base wherein the rod extends from the seat to the frame through the point.

In another embodiment of the present invention, a system for creating motion is provided. The system has an assembly that has a base and a frame wherein the base and the frame are connected by legs extending therebetween. A rod extends from the base towards the frame. Cylinders are connected to the rod at one end and to the frame at the opposite end. Means for controlling supply and release of air to the cylinder to move the rod and the base in a programmable manner is also provided.

In an embodiment, ball joints are connected at opposite ends of each of the cylinders.

In an embodiment, only two cylinders are provided that are connected between the rod and the frame.

In an embodiment, a connecting element having a ball joint is connected between the base and one of the legs of the assembly. A cylinder may be incorporated with the connecting element.

In an embodiment, a connecting element has first and second ball joints wherein the connecting element is attached at one end to the base and at the opposite end to one of the legs of the assembly.

In another embodiment of the present invention, a method for creating motion is provided. The method comprises the steps of: providing an assembly having a base and a frame; connecting the base and the frame by a plurality of legs wherein the base is pivotally supported by the plurality of legs; providing a rod extending from the base in a direction toward the frame; connecting cylinders to the rod and the frame; and controlling supply and release of air to the cylinders to create movement in the rod and motion to the base.

In an embodiment, a connecting element is provided between the base end and one of the plurality of legs wherein the connecting element includes a ball joint.

In an embodiment, a cylinder incorporated with the connecting element is provided.

In an embodiment, ball joints are provided at each end of the cylinders.

In an embodiment, the number of cylinders is two.

It is, therefore, an advantage of the present invention to provide an apparatus, a system, and a method for simulating motion.

Yet another advantage of the present invention is to provide a system and method for simulating motion in an economical manner.

A still further advantage of the present invention is to provide an apparatus, a system, and a method for simulating motion having two or three degrees of freedom.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
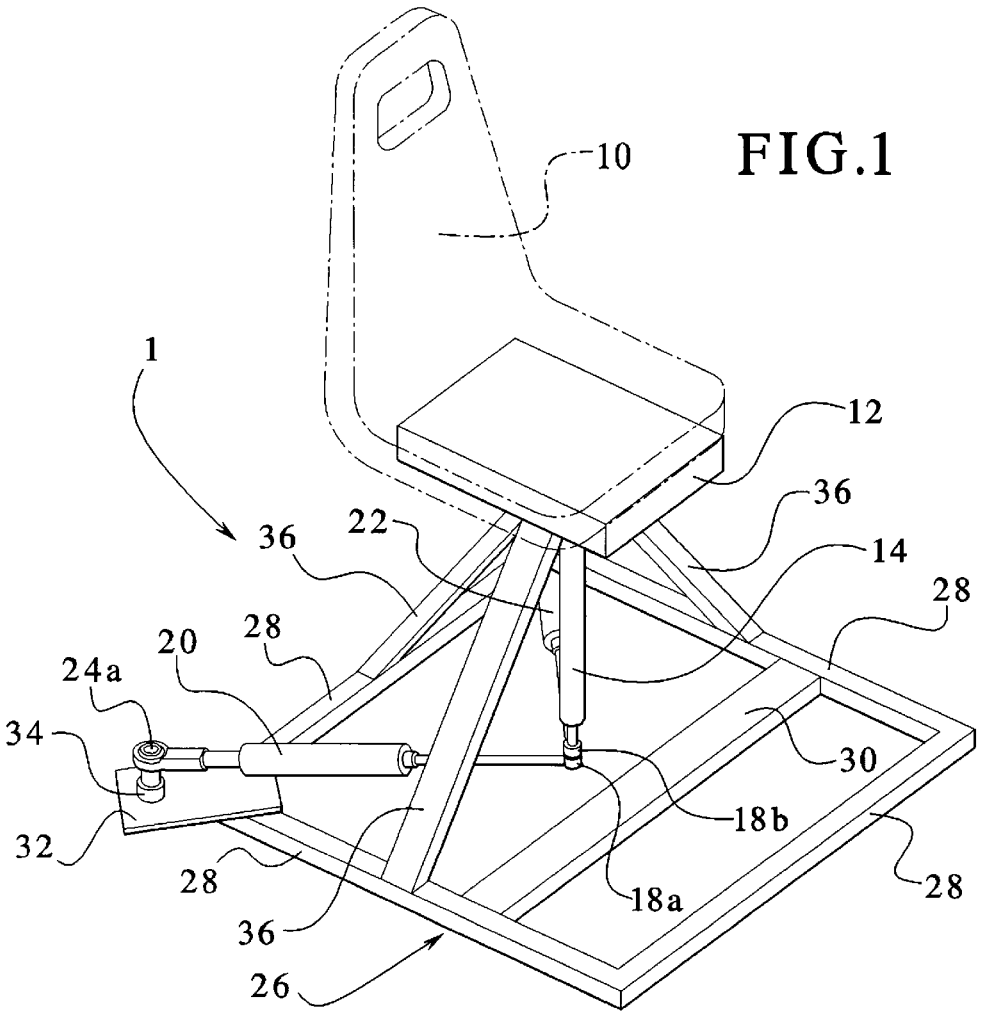
FIG. 1 generally illustrates a perspective view of an embodiment of an assembly of the present invention on which motion may be simulated.

The present invention generally relates to an apparatus and system including a seat, related platform and structure for providing movement to the platform and seat on which a viewer or individual is sitting to simulate motion being, for example, observed by a viewer or motion to be experienced in, for example, an arcade game or the like. This application incorporates by reference in its entirety U.S. Pat. No. 5,496,220 to Engstrand.

Referring now to the drawings wherein like numerals refer to like parts, FIGS. 1–4 generally illustrate a system 1 on which a viewer or other user may experience the effects of images being viewed or other program signals creating motion to the system 1. To this end, the system 1 includes a seat 10 on which an individual may sit or otherwise situate for experiencing the motion that is transferred to the system 1. It should be appreciated that the seat 10 may be replaced by multiple seats or a platform on which two or more individuals may also experience the same motion transferred to the system 1. The seat 10 is connected to a base 12 which, in turn, is operatively connected to a rod 14 via a ball joint 16 (shown in FIG. 4) that allows the base 12 to pivot.

The rod 14 may be connected to the ball joint 16 at one end and, at an opposite end, the rod 14 may be connected to a pair of ball joints 18*a*,18*b*, one stacked atop the other. Those ball joints 18*a*,18*b* are, in turn, connected to cylinders 20,22, respectively, that may be controlled to provide motion to the chair in a desired, programmable fashion as is disclosed in detail in U.S. Pat. No. 5,694,220, the disclosure of which is incorporated herein in its entirety.

Figure 3:
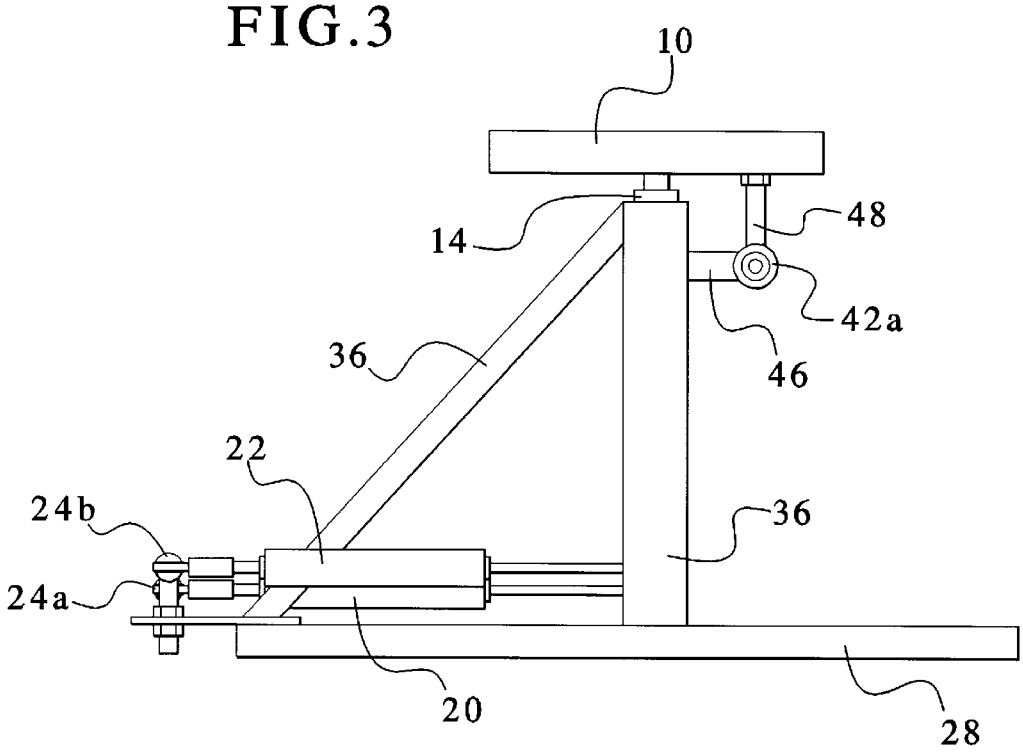
FIG. 3 illustrates a side view of an embodiment of the present invention of an assembly of the present invention for simulating motion.

The opposite ends of the cylinders 20,22 are, in turn, connected to ball joints 24*a*, 24*b* seen more clearly in FIG. 3. The ball joints 24 allow for pivoting movement therearound and translation of that movement to the rod 14 and to the base 12 and ultimately to the seat 10 of the individual using the system 1.

The remainder of the system 1 is a frame assembly 26 which attaches and supports the aforementioned components. The frame assembly 26 includes legs 28 connected in a substantially rectangular fashion for providing support for the remainder of the system 1. In addition, a brace 30 may be provided between two of the legs 28 to provide additional structural integrity to the frame assembly 26. The ball joints 24*a*,24*b* are mounted to plates 32 via support rods 34*a*, 34*b*, respectively. Although only one of the plates 32 and one of the support rods 34*a* are shown connected to the ball joint 24*a* in the cylinder 20, the equivalent structure is provided at an opposite corner of the frame assembly 26 to connect the cylinder 22 to the frame assembly 26.

As shown more clearly in FIG. 3, one of the ball joints 24*b* connected to the cylinder 22 is mounted slightly higher from the plate 32 than the other ball joint 24*a* which is connected to the cylinder 20. As a result, the cylinder 20 extends to the ball joint 18*a* and the cylinder 22 extends to the ball joint 8*b* which, in turn, are connected to the rod 14.

In addition, three diagonally oriented legs 36 connected between the legs 28 of the frame assembly 26 are provided. The legs 36 meet at a connecting element 38 through which the rod 14 extends. The connecting element 38 includes the ball joint 16 that connects to the base 12 and the rod 14. As a result, the rod 14 is translatable for pivoting within the connecting element 38 by means of the ball joint 16.

Figure 2:
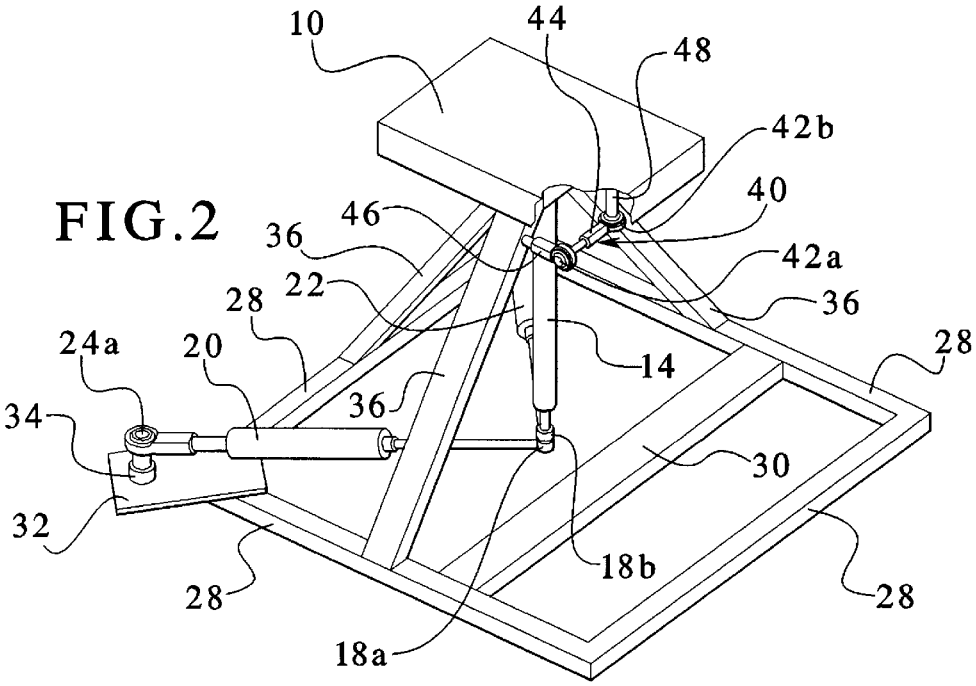
FIG. 2 illustrates a perspective view partially cut away of the embodiment illustrated in FIG. 1.

In addition to the foregoing, another pivoting connector 40 is provided as most clearly illustrated in FIGS. 2 and 3 that includes a first ball joint 42*a* and a second ball joint 42*b* with a rod 44 connected therebetween. The first ball joint 42*a* is connected to one of the legs 36 of the base assembly 26 via a rod 46, and the second ball joint 42*b* is connected to the base 10 by another rod 48 therebetween. As a result, the seat may pivot to the extent allowed by the ball joints 42*a*,42*b* of the pivoting connector 40.

Figure 4:
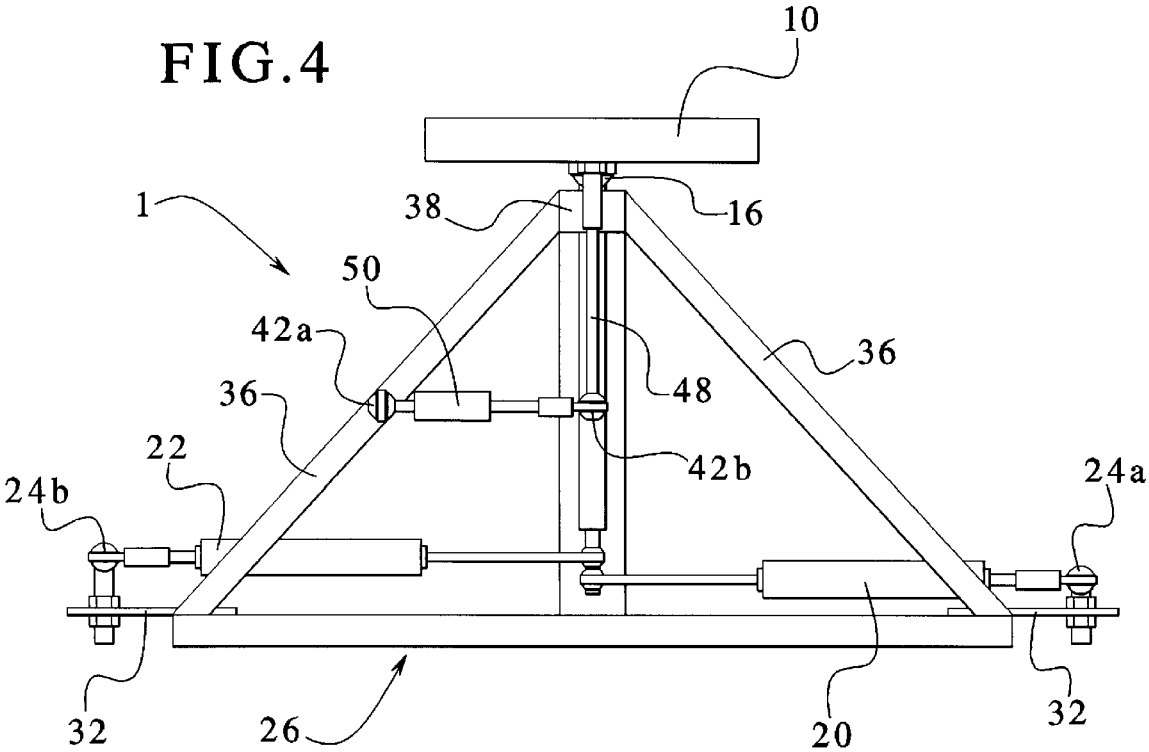
FIG. 4 illustrates a side view of another embodiment of an assembly of the present invention for simulating motion having three degrees of freedom.

Referring now to FIG. 4, an alternate embodiment of the present invention is illustrated. In this embodiment, the connecting rod 44 between the ball joints 42*a*,42*b* may be replaced at least in part with a cylinder 50 to provide an additional degree of freedom and motion to the base 12 and ultimately the seat 10 of the system 1. In this regard, the rod 48 is extended in length between the base 12 and the ball joint 42*b* in order to accommodate the length of the cylinder 50 between the ball joints 42*a*,42*b*. The ball joint 42*a* is further connected by a rod (not shown) to the leg 36 of the base assembly 26.

As generally disclosed and described in U.S. Pat. No. 5,496,220, the disclosure of which is incorporated herein by reference in its entirety, the system 1 of the present invention and the specific orientation of the seat 10 with the base 12 and the elements that are used to construct the entire system 1 including the position of the pneumatic cylinders 20, 22 and/or 50 allows for manipulation of the base 10 and the connected seat 12 in either two or three degrees of freedom, three degrees of freedom being achievable with the embodiment shown and illustrated with respect to FIG. 4. A controller, as shown and described in U.S. Pat. No. 5,496,220, may be implemented to control the motion to each of the cylinders and, hence, the ultimate motion experienced by a user on the seat 10 of the system 1. In this regard, supply and release valves are implemented and operatively associated with the controller and the cylinders 20,22 and/or 50 controlling the amount of air supplied or released therefrom.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for experiencing motion, the apparatus comprising:

a frame;

a base substantially parallel to the frame in a resting position and remotely situated from the frame;

a rod extending from the base in a direction towards the frame;

a first cylinder connected between the rod and the frame; and a second cylinder connected between the rod and the frame wherein the first cylinder and the second cylinder expand and contract to provide motion to the base and further wherein the first cylinder and the second cylinder are rotatably connected to the rod at a common end of the rod.

2. The apparatus of claim 1 further comprising:

a connecting element between the frame and the base wherein the connecting element includes a ball joint.

3. The apparatus of claim 2 further comprising:

a third cylinder incorporated with the connecting element.

4. The apparatus of claim 1 further comprising:

a ball joint at each end of each of the first cylinder and the second cylinder wherein the first cylinder and the second cylinder commonly meet at one end vertically disposed from each other.

5. The apparatus of claim 1 further comprising:

a ball joint between the base and the rod.

6. The apparatus of claim 1 further comprising:

a connecting element having first and second ball joints wherein the connecting element is attached at one end to the base and at an opposite end to the frame.

7. The apparatus of claim 1 further comprising:

a plurality of legs extending between the frame and the base wherein the plurality of legs are disposed to meet at a point beneath the base wherein the rod extends from the seat to the frame through the point.

8. A system for creating motion, the system comprising:

an assembly having a base and a frame wherein the base and the frame are connected by legs extending therebetween;

a rod extending from the base towards the frame;

cylinders connected to the rod at one end and to the frame at the opposite end and further wherein the cylinders are connected to the rod at a common end of the rod; and means for controlling supply and release of air to the cylinder to move the rod and the base in a programmable manner.

9. The system of claim 8 further comprising:

ball joints connected at opposite ends of each of the cylinders.

10. The system of claim 8 wherein only two cylinders are provided connected between the rod and the frame.

11. The system of claim 8 further comprising:

a connecting element having a ball joint connected between the base and one of the legs of the assembly.

12. The system of claim 11 further comprising:

a cylinder incorporated with the connecting element.

13. The system of claim 8 further comprising:

a connecting element having first and second ball joints wherein the connecting element is attached at one end to the base and at the opposite end to one of the legs of the assembly.

14. A method for creating motion, the method comprising the steps of:

providing an assembly having a base and a frame;

connecting the base and the frame by a plurality of legs wherein the base is pivotally supported by the plurality of legs;

providing a rod extending from the base in a direction toward the frame;

connecting cylinders to the rod and the frame wherein the cylinders are connected to the rod at a common end of the rod; and controlling supply and release of air to create movement in the rod and motion to the base.

15. The method of claim 14 further comprising:

providing a connecting element between the base and one of the plurality of legs wherein the connecting element includes a ball joint.

16. The method of claim 15 further comprising:

providing a cylinder incorporated with the connecting element.

17. The method of claim 14 further comprising:

providing ball joints at each end of the cylinders.

18. The method of claim 14 wherein the number of cylinders is two.

19. An apparatus for experiencing motion, the apparatus comprising:

a frame;

a base substantially parallel to the frame in a resting position and remotely situated from the frame;

a rod extending from the base in a direction towards the frame;

a first cylinder connected between the rod and the frame;

a second cylinder connected between the rod and the frame wherein the first cylinder and the second cylinder expand and contract to provide motion to the base; and a ball joint at each end of each of the first cylinder and the second cylinder wherein the first cylinder and the second cylinder commonly meet at one end vertically disposed from each other.

20. An apparatus for experiencing motion, the apparatus comprising:

a frame;

a base substantially parallel to the frame in a resting position and remotely situated from the frame;

a rod extending from the base in a direction towards the frame;

a first cylinder connected between the rod and the frame;

a second cylinder connected between the rod and the frame wherein the first cylinder and the second cylinder expand and contract to provide motion to the base; and a connecting element having first and second ball joints wherein the connecting element is attached at one end to the base and at an opposite end to the frame.

21. A system for creating motion, the system comprising:

an assembly having a base and a frame wherein the base and the frame are connected by legs extending therebetween;

a rod extending from the base towards the frame;

cylinders connected to the rod at one end and to the frame at the opposite end;

means for controlling supply and release of air to the cylinder to move the rod and the base in a programmable manner; and ball joints connected at opposite ends of each of the cylinders.

22. A system for creating motion, the system comprising:

an assembly having a base and a frame wherein the base and the frame are connected by legs extending therebetween;

a rod extending from the base towards the frame;

only two cylinders connected to the rod at one end and to the frame at the opposite end; and means for controlling supply and release of air to the cylinder to move the rod and the base in a programmable manner.

23. A system for creating motion, the system comprising:

an assembly having a base and a frame wherein the base and the frame are connected by legs extending therebetween;

a rod extending from the base towards the frame;

cylinders connected to the rod at one end and to the frame at the opposite end;

means for controlling supply and release of air to the cylinder to move the rod and the base in a programmable manner; and a connecting element having a ball joint connected between the base and one of the legs of the assembly.

24. A system for creating motion, the system comprising:

an assembly having a base and a frame wherein the base and the frame are connected by legs extending therebetween;

a rod extending from the base towards the frame;

cylinders connected to the rod at one end and to the frame at the opposite end;

means for controlling supply and release of air to the cylinder to move the rod and the base in a programmable manner; and a cylinder incorporated with the connecting element.

25. A system for creating motion, the system comprising:

an assembly having a base and a frame wherein the base and the frame are connected by legs extending therebetween;

a rod extending from the base towards the frame;

cylinders connected to the rod at one end and to the frame at the opposite end;

means for controlling supply and release of air to the cylinder to move the rod and the base in a programmable manner; and a connecting element having first and second ball joints wherein the connecting element is attached at one end to the base and at the opposite end to one of the legs of the assembly.

26. A method for creating motion, the method comprising the steps of:

providing an assembly having a base and a frame;

connecting the base and the frame by a plurality of legs wherein the base is pivotally supported by the plurality of legs;

providing a rod extending from the base in a direction toward the frame;

connecting cylinders to the rod and the frame;

controlling supply and release of air to create movement in the rod and motion to the base; and providing ball joints at each end of the cylinders.

27. A method for creating motion, the method comprising the steps of:

providing an assembly having a base and a frame;

connecting the base and the frame by a plurality of legs wherein the base is pivotally supported by the plurality of legs;

providing a rod extending from the base in a direction toward the frame;

connecting two cylinders to the rod and the frame; and controlling supply and release of air to create movement in the rod and motion to the base.

* * * * *